United States Patent [19]

Saalasti

[11] 4,313,375

[45] Feb. 2, 1982

[54] BARK PRESS

[76] Inventor: Väinö T. Saalasti, Arinatie 4, 00370 Helsinki 37, Finland

[21] Appl. No.: 43,710

[22] Filed: May 30, 1979

[30] Foreign Application Priority Data

May 30, 1978 [FI] Finland ..... 781706

[51] Int. Cl.[3] ..... B30B 9/02

[52] U.S. Cl. ..... 100/37; 29/113 R; 100/121; 100/157; 100/211

[58] Field of Search ..... 100/DIG. 4, 37, 121, 100/211, 157; 29/113 R, 125

[56] References Cited

U.S. PATENT DOCUMENTS

| | | | |
|---|---|---|---|
| 558,572 | 4/1896 | Schacke | 100/157 |
| 2,870,481 | 1/1959 | Bonnafoux | 100/DIG. 4 |
| 3,383,884 | 5/1968 | Meyer | 29/113 R |

FOREIGN PATENT DOCUMENTS

| | | | |
|---|---|---|---|
| 1150283 | 6/1963 | Fed. Rep. of Germany | 100/121 |
| 1495 | 1/1900 | Finland . | |
| 31858 | 1/1962 | Finland . | |
| 15968 | 6/1902 | Sweden . | |
| 1542214 | 3/1979 | United Kingdom | 100/121 |

*Primary Examiner*—Billy J. Wilhite

*Attorney, Agent, or Firm*—Browdy and Neimark

[57] ABSTRACT

Water containing bark, or the like, is fed into a gap of a bark press, mounted in an inclined plane, the gap being formed between the inner face of a rotating large rigid perforated drum and the outer face of at least one of a plurality of independently rotating smaller compressor rolls. Water is expelled from the bark through the perforations in the drum. Any of the compressed bark which adheres to the drum or compressor roll surfaces is scraped therefrom, falls to the lower portion of the bark press where it is subjected to additional compressive forces and is finally collected at the lower end of the inclined bark press. The relatively dry bark, which is obtained, can be more effectively used as a fuel.

16 Claims, 2 Drawing Figures

BARK PRESS

The object of the invention is to press bark to obtain a form that can be used for fuel. It is known that bark is drained by pressing and after that it can be burnt. However, the dry substance content of the pressed bark obtained by the practice of present methods is just about 35 percent. Although this kind of bark also burns, it contains so much water that the bark has no heat value and the thermal energy of the bark is expended in evaporating the water which is in the bark. Therefore it cannot be called fuel which term is here defined as material which, when it is burned is a steam boiler, really produces thermal energy and does not dirty the boiler or diminish the efficiency of the boiler.

A further object of the invention is to develop a continuously functioning bark press, by means of which sufficient moisture can be economically removed from the bark content that the bark obtained is an effective fuel.

One has nowadays large quantities of bark at one's disposal which is simply water-running. In the pulp and paper mills in Finland the trees are usually stripped in wet or half-wet barking drums. The bark which leaves the barking drum is always wet with water, especially the bark of floated timber, the dry substance content of which is just about 10 to 20 percent. This bark material will, in the now known methods be led either into a stripper like a hammer mill, possessing a horizontal axle structure or into a stripper characterized by a vertical axle structure. The moisture of the bark remains in the stripper almost unchanged. After being processed by the stripper, the bark will be compressed by mechanic compressors. Of these, screw compressors, roller compressors, roller mat compressors continuously function and a hydraulic compressor periodically functions. The roller compressors and the roller mat compressors are no longer in use and the screw compressors have not been manufactured any more during the last few years. The drying effect of all of these is about the same. When the bark enters the compressor, its dry substance content is, when it is a question of drum stripped bark of floated whitewood or redwood, 12 to 22 percent. The dry substance content of the bark, on leaving the drying compressor, is at its best 40 to 50 percent but the average values of a longer time are, however, just 35 to 40 percent.

A thermal bark draining process is also known. The bark will be led, e.g., into a rotating drum and it is drained utilizing hot gases taken from a boiler. In other words the water in the bark will be expelled by evaporation. Drying by heating absorbs a large quantity of thermal energy and in addition requires a drying drum provided with heat-insulation layers and a conveyor system. The draining of this watery bark utilizing thermal energy by boiling off its water content is an expensive and uneconomical method.

In contrast to the known prior art procedures, the practice of the present process using the present improved bark press apparatus economically and substantially reduces the water content of the bark to provide an effective fuel. Briefly, the bark is fed into an arcuate gap located between the inner face of a relatively large rotating drum and the resilient face of a relatively small independently rolling presser roll located within the drum, so that the water entrapped in the bark is expelled at the arcuate operative portions of the drum and the presser roll faces through the perforations in the drum in the arcuate area.

The draining of the above described bark which has been stripped off floated timber in a watery barking drum is described in more detail in the description appearing hereunder. The bark is wet, slimy and in its construction hard to drain because it has loosened from a tree in long stripes. The bark which leaves the barking drum will at first be conveyed into a gravel, stone and iron separator. After this the bark, the dry substance content of which varies between 10 to 20 percent, will be transferred on a screw or band conveyor into a continuously functioning bark press in accordance with the present invention.

Figure 1:
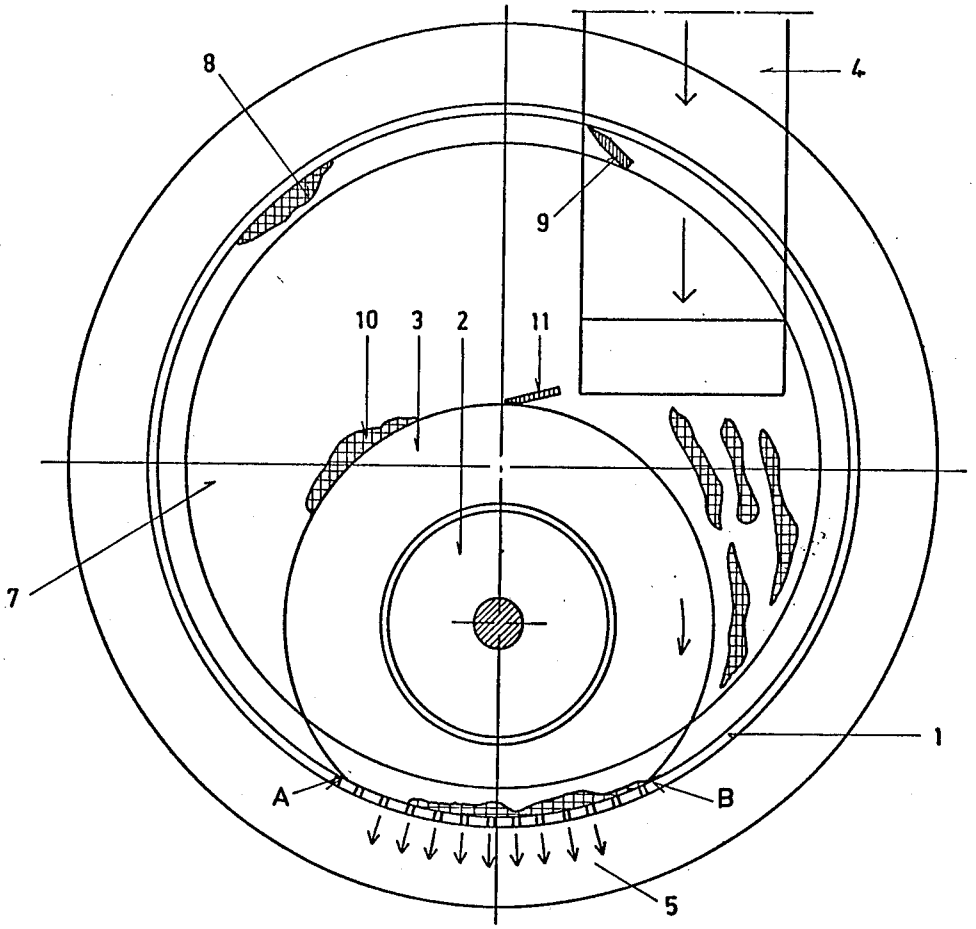
FIG. 1 shows a side view of a continuously operating bark press.

In more detail, FIG. 1 shows a continuously functioning bark press equipped with inside press rings. The structure denomenated by the numeral 1 is a perforated and rotating fitted drum, inside of which there are pressing or compressor rolls, identified by numeral 2, each possessing a resilient surface. These rolls can be pneumatic tyres or heavy iron rolls, the outer surface of which has been provided, e.g. overlaid, with an elastic, e.g. rubber, layer 3. The air-filled tyre collapses when touching the inside face of the drum 1. The wet bark comes out of the channel 4 and is fed to the downwardly decreasing gap between drum 1 and the outer face of the pressing roll 2. The pressing roll 2 provided with a rough surface also pulls the slippery bark under itself. After the elastic tyre has collapsed, its outside face touches the inside of the drum 1 along the tangential arc extending from A to B. If a pneumatic tyre is used, the same pressure which is inside the pneumatic tyre, is directed to the bark along arc A-B, that is e.g. 3 to 8 kg per $cm^2$. Thus this pressure expels water from within the bark along the points denoted by arrows 5, that is between arc A to B through the perforated drum.

Figure 2:
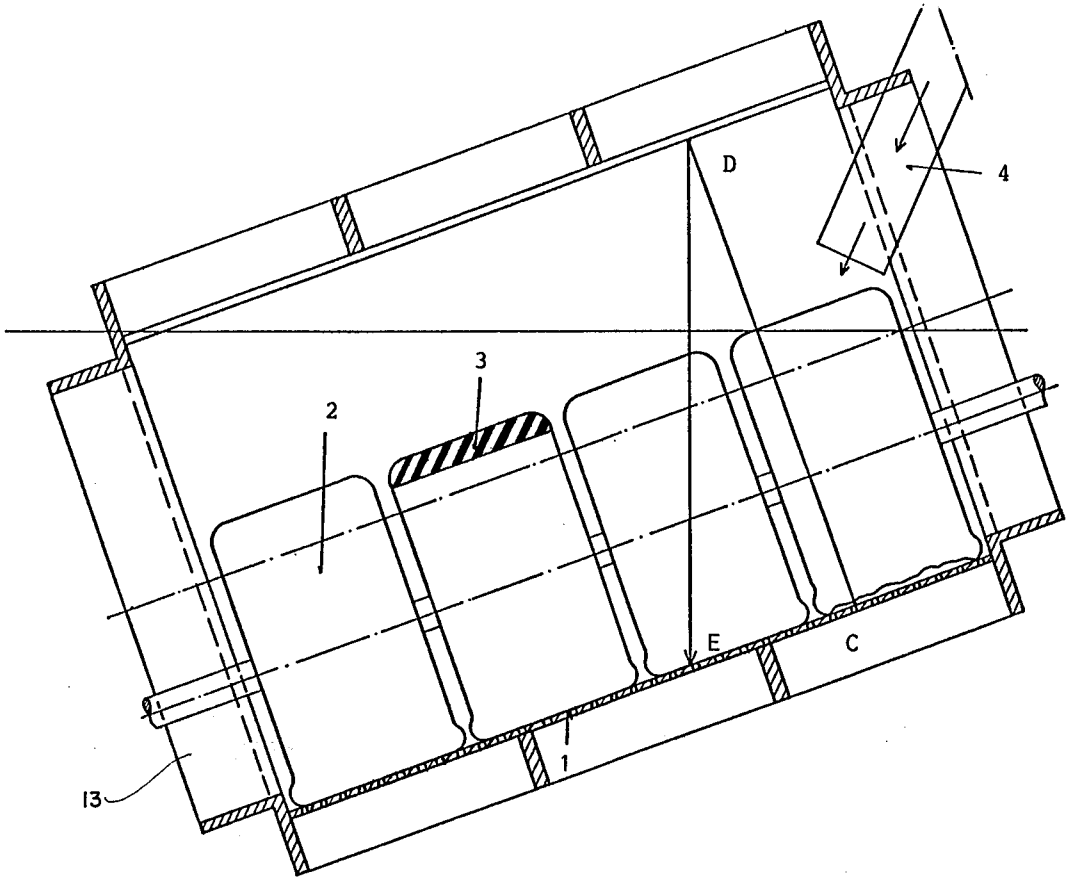
FIG. 2 shows a cross-sectional view of the bark press assembly shown in FIG. 1.

The watery bark is fed between the drum and the pressing roll into a space 7 behind the pressing roll. Part of the bark 8 remains on the inside of the drum. When the drum rotates, this point moves to the scraper 9 and the bark falls down. Part of the bark also sticks to the pressing roll 10 and moves with it upwards until the scraper 11 loosens it. The scrapers 9 and 11 are fixedly positioned with respect to the pressing roll 2 and the drum 1 by conventional means (not illustrated). The scrapers 9 and 11 have not been shown in FIG. 2 for the sake of clarity. The bark loosened by both scrapers falls naturally straight down, as shown in FIG. 1. As shown in FIG. 2, the axis of the drum is mounted in a plane inclined from the horizontal so that the front of the drum, that is that end where the bark is introduced, is higher, than the other end 13, where the bark comes out. Thus when the drum lifts, on rotating, the bark adhered to its surface, e.g., from the point C, up to the point D (FIG. 2) is loosened by the scraper 9 from said drum surface and falls down to the point E. In the same way the pressing roll feeds the bark that has adhered to it or has come over it about the half of the above mentioned feeding length forwards. So the bark, several times, is successively subjected to pressure, always in a new position and each time part of the water is expelled from it.

The construction in accordance with the invention can be changed within the limits of the claims, e.g., so that there are several pressing rolls successively located within the drum in the direction of rotation.

Power can be transmitted from an engine to the drum by known methods. Due to the nature of the invention it is, however, useful to transmit the motive power to the pressing roll, for the bark comes in this case not only under pressure but also under a shearing force and the water is expelled from the bark more efficiently.

When the bark leaves this continuously functioning bark press, e.g. from the lower end of the press such as shown at the left hand side of FIG. 2, its dry substance content is 45 to 55 percent. As such it will be led forwards to, e.g., a bark stripper.

What is claimed is:

1. A method for substantially reducing the concentration of entrapped water contained in bark material comprising the steps of feeding said bark material to a bark press provided with a gap formed between an inner face of a rotating relatively large and rigid perforated drum and an outer face of at least one relatively small and compressible resilient presser roll eccentrically mounted within the drum, independently rotating in compressive relationship said at least one presser roll against a portion of said inner face of said perforated drum thereby distorting an arcuate portion of said outer face of said at least one presser roll and applying substantial pressure against a portion of said inner face of said perforated drum abutting said arcuate portion of said at least one presser roll to cause expulsion of entrapped water contained in said bark through the perforations located in that portion of said drum which abuts said at least one pressure roll wherein compressive forces are being exerted upon said bark material; and feeding the bark along the length of the drum so that the bark is compressed several times before exiting.

2. A process as claimed in claim 1 wherein the perforated drum is mounted with its axis in a plane inclined from the horizontal whereby bark material respectively adhering to the face of the drum and at least one presser roll, on falling due to gravity, will again be subjected to compressive forces acting between said drum and presser roll surfaces.

3. A process, as claimed in claims 1 or 2, wherein a plurality of presser rolls are located within the interior of the perforated drum of the bark press.

4. A process, as claimed in claim 1, comprising removing bark from the face of said drum and presser roll by scraping so that bark falls to a lower compressive area of said bark press.

5. A process, as claimed in claim 1, wherein the at least one presser roll is provided with an elastic surface layer.

6. A process, as claimed in claim 5, where said presser roll is of a pneumatic tire-like construction.

7. A process as claimed in claim 1, wherein said presser roll presses against said drum at a pressure of 3–8 kg/cm$^2$.

8. A bark press for removing significant water concentrations from wet bark material comprising a relatively large rotating perforated drum having an inner surface; at least one relatively small independently rotating compressible resilient presser roll having an outer surface and eccentrically mounted within the interior of said drum to form an arc of contact between the outer surface of the compressible presser roll and the inner surface of the drum; means to feed wet bark into said arc of contact; means to compress wet bark between abutting surfaces along said arc of contact under substantial pressure to a degree sufficient to expel substantial concentrations of water from said bark through the perforations in said drum whereby the water content of the said bark is significantly reduced to obtain relatively dry bark as more effective fuel material; and means to discharge the relatively dry bark from the press.

9. A bark press, as claimed in claim 8, wherein said perforated drum and said at least one presser roll are mounted in an inclined plane.

10. A bark press, as claimed in claim 8, wherein a plurality of presser rolls are located within the interior of said perforated drum.

11. A bark press, as claimed in claim 8, wherein said drum and said at least one presser roll are each provided with a scraper blade.

12. A bark press, as claimed in claim 8, wherein the at least one presser roll is provided with a resilient surface layer.

13. A bark press, as claimed in claim 12, wherein said resilient surface layer comprises an elastic material.

14. A bark press, as claimed in claim 12, wherein a pneumatic tire carcass constitutes the presser roll.

15. A bark press, as claimed in claim 8, wherein said means to compress the wet bark along said arc of contact comprises means for effecting a pressure of from substantially 3 to substantially 8 kg/cm$^2$.

16. A bark press, as claimed in claim 8, further including means for transmitting power to the area of the bark press where the at least one presser roll is located, through said presser roll.

* * * * *

UNITED STATES PATENT AND TRADEMARK OFFICE

CERTIFICATE OF CORRECTION

PATENT NO. : 4,313,375

DATED : February 2, 1982

INVENTOR(S) : Väinö T. SAALASTI

It is certified that error appears in the above-identified patent and that said Letters Patent are hereby corrected as shown below:

Column 1, line 14, delete "is" (second occurrence) and insert --in--

Column 3, line 13, delete "stripper" and insert --shredder--

Signed and Sealed this

Fourth Day of May 1982

[SEAL]

*Attest:*

GERALD J. MOSSINGHOFF

*Attesting Officer*

*Commissioner of Patents and Trademarks*